US005839763A

United States Patent [19]

McCannel

[11] Patent Number: 5,839,763

[45] Date of Patent: Nov. 24, 1998

[54] SECURITY CARD AND METHOD OF MANUFACTURE

[76] Inventor: Duncan McCannel, 3615 Great Oaks Cir., Eagan, Minn. 55123

[21] Appl. No.: 721,426

[22] Filed: Sep. 26, 1996

[51] Int. Cl.[6] ..... B42D 15/00

[52] U.S. Cl. ..... 283/109; 283/75; 283/107; 283/904

[58] Field of Search ..... 283/109, 107, 283/904, 75

[56] References Cited

U.S. PATENT DOCUMENTS

| | | | |
|---|---|---|---|
| 3,854,229 | 12/1974 | Morgan | 283/109 |
| 4,004,058 | 1/1977 | Buros et al. | 283/107 |
| 4,479,838 | 10/1984 | Dunsirn et al. | 156/247 |
| 4,497,872 | 2/1985 | Hoppe et al. | 283/904 |
| 4,519,155 | 5/1985 | Gallagher et al. | 283/904 |
| 4,911,477 | 3/1990 | Shishido | 283/904 |
| 5,318,326 | 6/1994 | Garrison | 283/109 |

FOREIGN PATENT DOCUMENTS

| | | | |
|---|---|---|---|
| 496377 | 7/1992 | European Pat. Off. | 283/107 |
| 283192 | 11/1989 | Japan | 283/75 |
| 212894 | 8/1992 | Japan | 283/107 |

*Primary Examiner*—Daniel W. Howell
*Assistant Examiner*—Adesh Bhargava
*Attorney, Agent, or Firm*—Merchant, Gould, Smith, Edell, Welter & Schmidt, P.A.

[57] ABSTRACT

A security card and a method of manufacturing security cards are provided by the invention. The security card includes a peel away cover having a top film and a first transparent film adhered thereto, a card base having a substrate with a second transparent film adhered to the top surface of the substrate surface; and clean release adhesive releasably adhering the first transparent film of said peel away cover to the second transparent film of said card base.

7 Claims, 2 Drawing Sheets

SECURITY CARD AND METHOD OF MANUFACTURE

FIELD OF THE INVENTION

The invention is directed to a security card and to a method for manufacturing security cards. More particularly, the invention is directed to a phone card type security card.

BACKGROUND OF THE INVENTION

The prior art is generally cognizant of phone cards and lottery cards which include valuable information. In the case of phone cards, the valuable information is generally a pin number which can be used to make phone calls. For lottery cards, the valuable information is whether the card can be redeemed for prizes or money. In many cases, the valuable information can be accessed by scratching off a coating which is provided over the valuable information.

Because the cards contain valuable information, it is desirable to use high quality plastic cards which can withstand the stresses associated with being carried in a pocket. Furthermore, it is desirable to provide that once the card has been opened and the valuable information has been released, the card cannot be reassembled and resold. In this way, one would recognize whether the information contained in the card has been compromised.

Prior art phone cards often include a pressure sensitive release adhesive for holding the layers together. Once the user separates the layers of the card by peeling them apart, a layer of tacky pressure sensitive adhesive material remains on one or both of the layers after separation. This tacky material is an annoyance to many users and, in certain circumstances, may allow the layers to be placed back together in order to hide the fact that the valuable information has been compromised.

SUMMARY OF THE INVENTION

The invention is directed to a security card. The security card includes a peel away cover and a base card which are adhered together by a clean release adhesive. The peel away cover includes a top film and a first transparent film adhered thereto. The card base includes a substrate and a second transparent film adhered thereto. The clean release adhesive is provided between the first transparent film and the second transparent film, and releasably adheres the transparent films together.

The invention is additionally directed to a method for manufacturing a security card. The method includes the steps of: providing a first transparent film and a second transparent film adhered together by a clean release adhesive; adhering an exposed surface of the first transparent film to a top film; and adhering an exposed surface of the second transparent film to a substrate surface.

DETAILED DESCRIPTION OF THE PREFERRED EMBODIMENT

Figure 1:
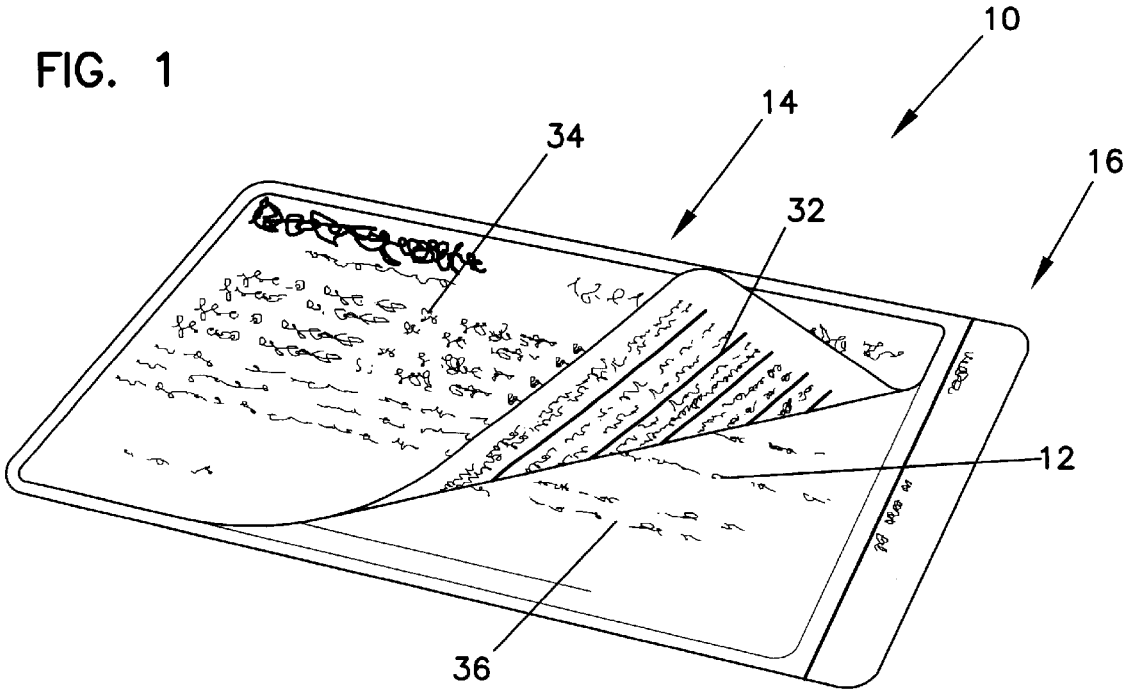
FIG. 1 is a perspective view of a partially dissembled security card according to the principles of the present invention.
Figure 2:
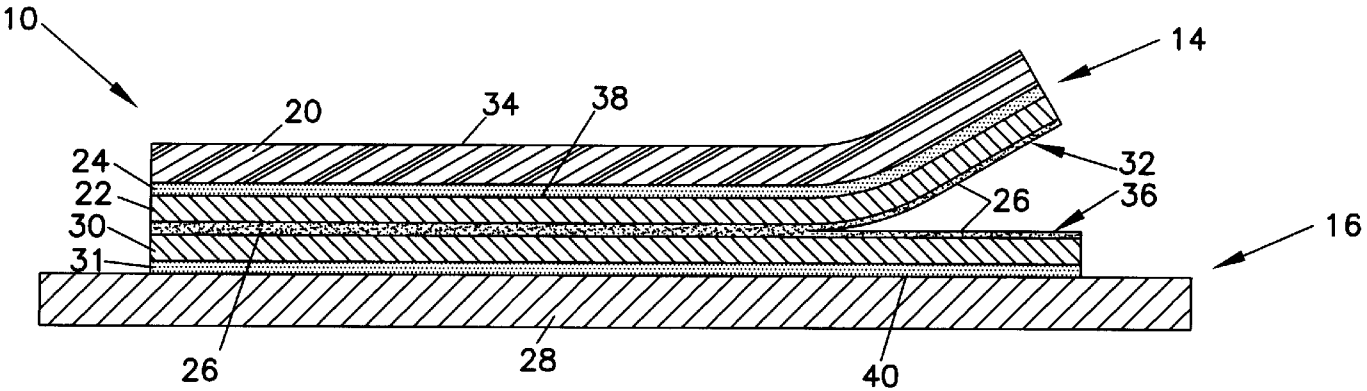
FIG. 2 is a side view of the security card of FIG. 1 wherein the peel away cover is partially peeled away from the base card.

Referring to FIGS. 1–2, a preferred embodiment of the security card according to the invention is shown at reference numeral 10. The security card 10 according to the invention contains valuable information which is generally identified by the reference numeral 12. The valuable information 12 can remain secret until the security card is opened by separating the peel away cover 14 from the card base 16.

It should be understood that a security card refers to a card containing information which is valuable or may be potentially valuable to the person receiving the card. Exemplary types of security cards include phone cards, lottery cards, sports cards, and the like. In the case of a phone card, the valuable information can be a pin number which provides a specified amount of calling time. In the case of a lottery card, the valuable information informs the user whether he or she has won a prize. Sports cards often include the photo and statistics of a professional sports athlete. The card is called a security card because it indicates when the valuable information has been released. In the context of this invention, it means that once the peel away cover 14 and the card base 16 are separated, they cannot be reattached. Thus, it is clear to one that the security card has been opened. This feature of the invention is discussed in more detail below.

Now referring to FIG. 2, a side view of the security card 10 is provided. The peel away cover 14 is shown as a multilayer structure having a top film 20, a first transparent film 22, and an adhesive layer 24 adhering the two films together. The card base 16 is a multilayer structure having a substrate 28, a second transparent film 30, and an adhesive layer 31 for adhering the film and substrate together. The peel away cover 14 and the card base 16 are releasably adhered together by a layer of clean release adhesive 26. As shown, part of the clean release adhesive remains with both of the peel away cover 14 and the card base 16 as they are separated.

As shown in FIG. 1, the security card 10 shows printing on the inside and outside surfaces 32, 34 of the peel away cover 14, and on the top surface 36 of the card 16. It is believed that upon casual observation of the surfaces provided by the security card 10, it would appear that printing is provided at the indicated locations. The actual location of the printing, however, can be different for two of the surfaces. For example, the printing which appears on the inside surface 32 of the peel away cover 14 is actually reverse printing which is provided on the top surface 38 of the first transparent film 22, and the printing which appears on the top surface 36 of the card base 16 is actually printing on the surface 40 of the substrate 28. It will be apparent that this arrangement provides for advantageous manufacturing of the security cards. Furthermore, it is an advantage of the invention that the first transparent film 22 and the second transparent film 30 can protect the printing which the films cover.

The adhesive layers 24, 31 may be of the same or different material, and are preferably sufficiently transparent to allow the printing, which they cover, to show through, and sufficiently tacky to keep the layers together under normal conditions. Pressure sensitive adhesives, such as those commonly used in the printing art, are preferred for this application. It is preferred that the adhesive layers are provided with a thickness sufficient to provide the desired adhesion, but should not be too thick so as to waste material. For most pressure sensitive adhesives, it is believed that a thickness of between about 0.25 mil and 0.75 mil is sufficient, and a thickness of about 0.5 mil is preferred.

An important feature of the invention is the use of the clean release adhesive 26 which adheres the peel away cover 14 to the card base 16. An exemplary clean release adhesive is described in U.S. Pat. No. 4,479,838 to Dunsirn et al., the entire disclosure of which is incorporated herein by reference. A commercially available product which can be used to provide the first transparent film 22 and the second transparent film 30 adhered together by the clean release adhesive 26 is sold as "Universal Coupon Base" and is available from 3SIGMA of Columbia, S.C. This commercially available product may be referred to as "coupon base."

It is understood that the clean release adhesive which can be used in the invention is preferably a substantially transparent layer of dry residue adhesive having selected adhesive strength. The term "dry residue adhesive" as used herein shall refer to an adhesive that is dry and non-tacky when the films are pulled away. In this manner, once the films are separated, they cannot be re-attached or re-adhered together. Is should be appreciated that for certain sports cards (and lottery cards), the value of the card is related to whether it has been opened. Cards that have not been opened are typically more valuable.

The pressure sensitive adhesive and the dry residue adhesive are selected so that the adhesion caused by the pressure sensitive adhesive is greater than the adhesion caused by the dry residue adhesive. Consequently, the peel away cover 14 can be removed from the card base 16 without tearing or otherwise destroying either sheet and without removing the base sheet from the mounting surface. It should be appreciated that the clean release adhesive can be applied in a pattern, such as circles, lines, zigzags, and the like, in order to effect the adhesion between the peel away cover and the card base, and to effect the amount of residue left behind. For example, using less adhesive is generally preferred because it is less likely to be detected visually or by touch. It is preferable when one does not feel or see any residue when the peel away cover and the card base are separated.

Figure 3:
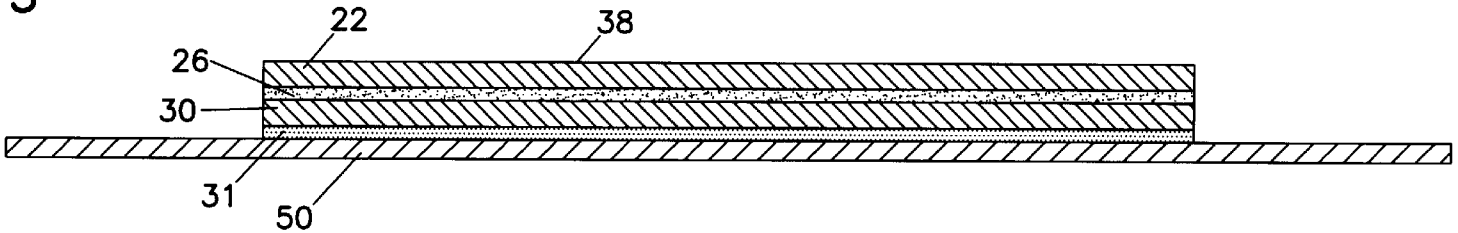
FIG. 3 is a side view of a portion of coupon base shown as a precursor of the security card of FIGS. 1 and 2.

A side view of coupon base 44 is provided by FIG. 3. The coupon base 44 is shown as a multilayer structure of first transparent film 22, second transparent film 30, clean release adhesive layer 26, pressure sensitive adhesive layer 31, and release paper liner 50. The coupon base is generally purchased as a large roll containing all of the layers described in FIG. 3. If it is desired to provide printing on the surface 32, then the top surface 38 of the first transparent film 22 is provided with reverse printing. Of course, the step of reverse printing can be avoided if it is not desired to provide information and/or printing on the surface 32.

Figure 4:
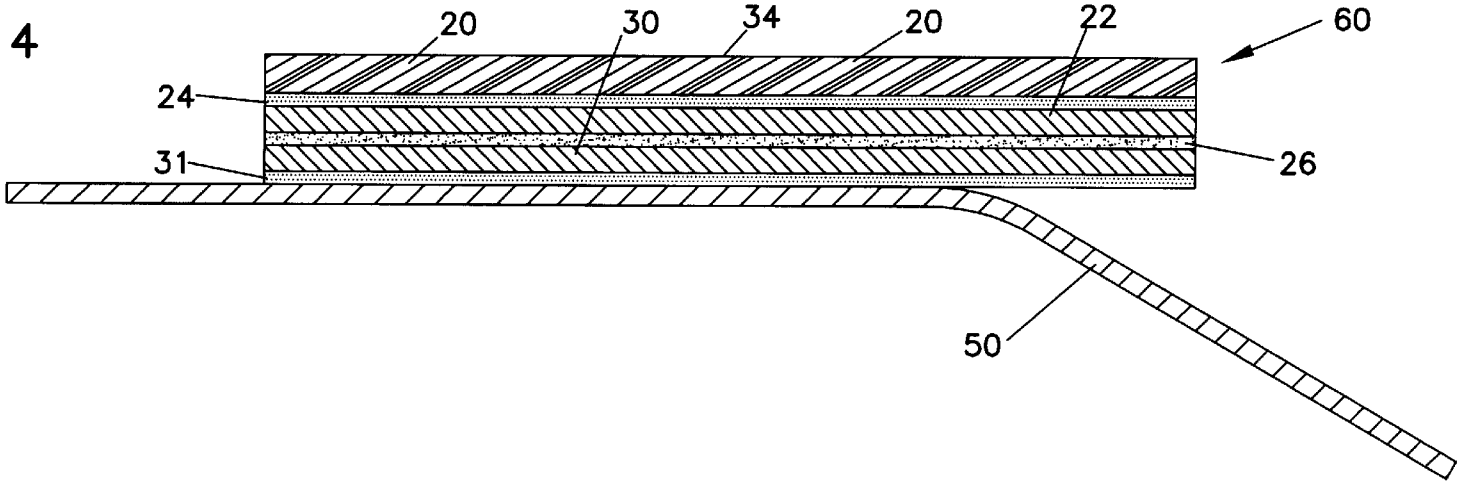
FIG. 4 is a side view of a later precursor of the security card of FIGS. 1 and 2.

Now referring to FIG. 4, on top of the coupon base 44 a top film 20 is provided, adhered by adhesive layer 24. It should be appreciated that if reverse printing is desired on the first transparent film 22, then the top film 20 is applied after the reverse printing step. It is generally preferred to use an opaque or white film as the top film 20 in order to hide the printing therebelow. The top film 20 is preferably the component of the peel away cover 14 which is primarily responsible for providing a thickness which is sufficient to grasp by the finger tips in order to peel it away. In a preferred embodiment, the thickness of the top film is between about 2 mil and about 5 mil, and is more preferably about 2.8 mil or about 3 mil.

It may be desirable to provide printing or information on surface 34, as shown in FIG. 1. If it is desirable to provide printing or information can be provided on surface 34, the top film 20 should be of a material which is capable of receiving printing or information. Such materials are known to those skilled in the art. Furthermore, it may be desirable to provide a coating over the printing on surface 34. This coating can be, for example, a varnish, a film, and the like. Coatings which could be used are known to those skilled in the art.

The coupon base can be provided with the shape of the peel away cover 14 by die-cutting. After die-cutting, a web of multilayer structure is removed leaving the remaining structure 60 shown in FIG. 4. The structure 60 can then be peeled away from the release paper 50 and applied to the surface 40 of the substrate 28 in order to provide the security card 10.

The top film 22 and the substrate 28 can be made of any convenient material. It is a particular advantage of the invention that they can both be made of plastic materials. Alternatively, they can be made of flexible paper, stiffer paper, cardboard, coated paper, and the like. It should be appreciated that plastic is a particularly preferred material because of the properties of flexibility and durability which can be provided. It will be apparent from further description of the invention that the ability to provide a security card based on a plastic is particular advancement over the prior art. In fact, the entire security card can be manufactured from plastic or polymeric materials and thereby provide an all plastic construction.

Because the dry residue adhesive is transparent, the surfaces 32, 36 are visually unobscured by any adhesive residue when the peel away cover 14 is removed from the card base 16. Consequently, printed material, designs, or attractive colors on the peel away cover 14 or the card base 16 are neither obscured nor disfigured.

Figure 5:
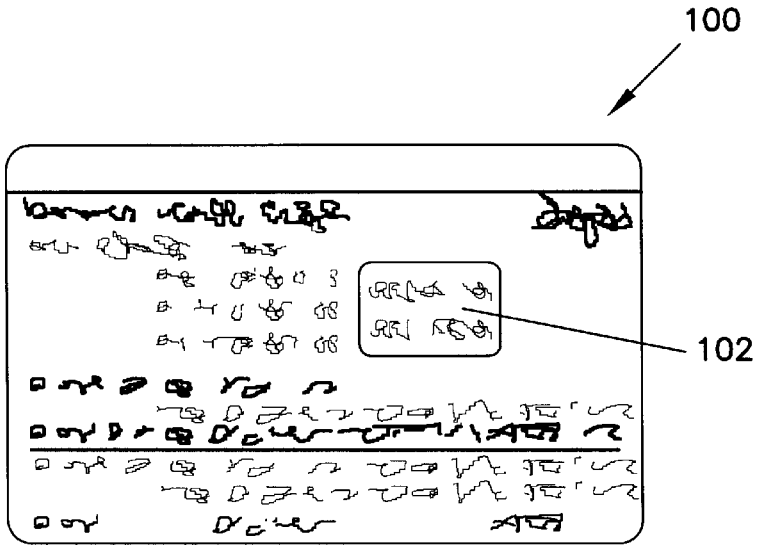
FIG. 5 is a top view of an alternative embodiment of a security card according to the principles of the present invention.

FIG. 5 shows an alternative embodiment of the invention where security card 100 is provided with a peel away cover 102 having a relatively small surface area in which to cover valuable information, such as, a pin number. The construction of the security card 100 can be similar to that described above.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A security card comprising:

a peel away cover including a top film and a first transparent film, wherein the first transparent film includes a surface having information printed thereon, said surface having information printed thereon being adhered to the top film;

a card base including a plastic substrate having a top surface and a second transparent film adhered to the top surface of the plastic substrate; and clean release adhesive releasably adhering the first transparent film of said peel away cover to the second transparent film of said card base.

2. The security card according to claim 1, wherein a pressure sensitive adhesive adheres the top film to the first transparent film.

3. The security card according to claim 1, wherein a pressure sensitive adhesive adheres the second transparent film to the substrate surface.

4. The security card according to claim 1, wherein the adhesive strength provided by the clean release adhesive for adhering the first transparent film and the second transparent film is significantly lower than the adhesive strengths provided between the top film and the first transparent film and between the substrate surface and the second transparent film.

5. The security card according to claim 1, wherein information is provided on the substrate surface, and the information is covered by the second transparent film.

6. The security card according to claim 1, wherein information is provided on a surface of the top film.

7. The security card according to claim 6, wherein a coating is applied over the information provided on the top film.

* * * * *